US007045264B2

(12) United States Patent
Yokota et al.

(10) Patent No.: US 7,045,264 B2
(45) Date of Patent: May 16, 2006

(54) SINGLE LAYERED ELECTROPHOTOGRAPHIC PHOTORECEPTOR

(75) Inventors: Saburo Yokota, Gyeonggi-do (KR); Hwan-koo Lee, Gyeonggi-do (KR); Kyung-yol Yon, Gyeonggi-do (KR); Beom-jun Kim, Gyeonggi-do (KR); Nam-jeong Lee, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 229 days.

(21) Appl. No.: 10/453,517

(22) Filed: Jun. 4, 2003

(65) Prior Publication Data

US 2003/0235771 A1 Dec. 25, 2003

(30) Foreign Application Priority Data

Jun. 7, 2002 (KR) ..... 10-2002-0031993

(51) Int. Cl.
*G03G 5/04* (2006.01)

(52) U.S. Cl. ..... 430/58.85; 430/56; 430/59.6; 430/96; 399/159; 399/262

(58) Field of Classification Search ..... 430/58.85, 430/59.6, 56, 96, 73; 399/159, 116, 162, 399/262

See application file for complete search history.

(56) References Cited

U.S. PATENT DOCUMENTS

| | | | | |
|---|---|---|---|---|
| 4,559,287 A | | 12/1985 | McAneney et al. | |
| 4,835,081 A | * | 5/1989 | Ong et al. | 430/58.25 |
| 5,013,623 A | | 5/1991 | Itoh et al. | |
| 5,075,487 A | * | 12/1991 | Akasaki et al. | 558/402 |
| 5,430,526 A | * | 7/1995 | Ohkubo et al. | 399/159 |
| 2003/0186158 A1 | * | 10/2003 | Yokota | 430/117 |

FOREIGN PATENT DOCUMENTS

| | | |
|---|---|---|
| JP | 02-051162 | 2/1990 |
| JP | 02-184857 | 7/1990 |
| JP | 06-123981 | 5/1994 |
| JP | 07-199492 | 8/1995 |
| JP | 07-287407 | 10/1995 |
| JP | 10-069107 | 3/1998 |
| JP | 10-239875 | 9/1998 |
| JP | 10-260541 | 9/1998 |
| JP | 11-202511 | 7/1999 |
| JP | 11-258839 | 9/1999 |
| JP | 2000-112157 | 4/2000 |

OTHER PUBLICATIONS

Electroded Photoconductivity of Electron Transport Active Matrix; Journal of Imaging Science, vol. 29, No. 2,; Mar./Apr. 1985; pp. 69-72.

Japanese Office Action corresponding to Japanese Patent Application 2003-164142.

European Search Report dated Nov. 5, 2004.

* cited by examiner

*Primary Examiner*—John L Goodrow
(74) *Attorney, Agent, or Firm*—Staas & Halsey LLP

(57) ABSTRACT

A single layered electrophotographic photoreceptor includes a photosensitive layer having at least a charge generating material, a hole transporting material, an electron transporting material, and a binder on a conductive support. The photosensitive layer includes a peculiar charge transfer complex (CT-complex) formed by the hole transporting material and the electron transporting material.

25 Claims, 1 Drawing Sheet

SINGLE LAYERED ELECTROPHOTOGRAPHIC PHOTORECEPTOR

CROSS-REFERENCE TO RELATED APPLICATIONS

This application claims the benefit of Korean Application No. 2002-31993, filed Jun. 7, 2002, in the Korean Intellectual Property Office, the disclosure of which is incorporated herein by reference.

BACKGROUND OF THE INVENTION

1. Field of the Invention

The present invention relates to a single-layered electrophotographic photoreceptor, and more particularly, to an electrophotographic photoreceptor having high sensitivity and a low residual potential, thus exerting good electrostatic properties.

2. Description of the Related Art

In general, an electrophotographic photoreceptor includes a photosensitive layer including a charge generating material, a charge transporting material and a binder resin, formed on a conductive substrate. As photosensitive layers, function-separation type photoreceptors having a laminated structure in which a charge generating layer and a charge transporting layer are laminated have been widely used.

In recent years, since single layered photoreceptors may be manufactured by a simplified process are advantageous due to effective chargeability, such photoreceptors are used in positive corona discharge, and generate a small amount of ozone. Hence, the single layered photoreceptors have attracted considerable attention, and extensive studies are underway.

Representative examples of conventional single layered electrophotographic photoreceptors include a photoreceptor comprising a PVK/TNF charge transfer complex as disclosed in U.S. Pat. No. 3,484,237, a photoreceptor comprising photoconductive phthalocyanine dispersed in a resin as disclosed in U.S. Pat. No. 3,397,086, a photoreceptor comprising a thiapyrylium and polycarbonate aggregate and a charge transporting material dispersed in a resin as disclosed in U.S. Pat. No. 3,615,440. However, those photoreceptors disclosed therein are not sufficiently effective in view of electrostatic properties and are considerably limited in selection of materials. Also, since such materials are harmful, the materials are not employed any longer.

Currently, single layered photoreceptors having a charge generating material, a hole transporting material and an electron transporting material dispersed in a resin, as described in Japanese Patent Publication 54-1633, have become the subject of development. Since such photoreceptors are functionally separated for charge generation and charge transporting, a wide variety of materials may be selected. Also, since the concentration of the charge generating material may be reduced, functional and chemical durability of the photosensitive layer may be enhanced.

Single layered photoreceptors that have been proposed to date exhibit substantially the same sensitivity level as laminated photoreceptors. However, the conventional single layered photoreceptors have slow light decay characteristics at a low electrical field area, resulting in an increase of residual potential. The increased residual potential may cause reduction of an image density, causes a memory effect, and restricts a design margin of an electrophotographic device, so that a remedy is needed. The slow light decay at the low potential area may have several causes. That is, since charge generating materials uniformly distributed in the photosensitive layer form trap sites, light decay may be caused by the combination of rapid discharge due to charges transported to solid solution of a charge transporting material and a resin as main components of the photosensitive layer and slow discharge due to charge trapping and detrapping at trap sites present in a low concentration.

To attain a single layered electrophotographic photoreceptor having a small residual potential, inventors of the present invention studied compositions of electrophotographic photoreceptors, and found out that the residual potential may be effectively reduced by including a peculiar charge transfer complex (CT-complex) having a hole transporting material and an electron transporting material in a photosensitive layer, thus completing the present invention.

SUMMARY OF THE INVENTION

The present invention includes an electrophotographic photoreceptor comprising a photosensitive layer having at least a charge generating material, a hole transporting material, an electron transporting material, and a binder on a conductive support, wherein the photosensitive layer includes a charge transfer complex (CT-complex) formed by the hole transporting material of Formula 1 and the electron transporting material of Formula 2:

Formula 1

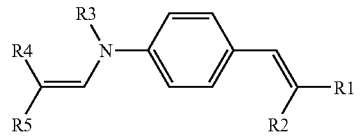

wherein R1 through R5 are independently selected from the group consisting of a hydrogen atom, a $C_1$–$C_{20}$ optionally substituted alkyl group, a $C_6$–$C_{20}$ optionally substituted aryl group, a $C_1$–$C_{20}$ optionally substituted alkoxy group and a $C_8$–$C_{20}$ optionally substituted styryl group;

Formula 2

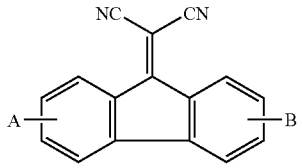

wherein A and B are independently selected from the group consisting of a hydrogen atom, a halogen atom, a $C_2$–$C_{20}$ optionally substituted alkoxycarbonyl group and a $C_2$–$C_{20}$ alkylaminocarbonyl group, wherein the hydrogen atom in the aromatic ring may be substituted by a halogen atom.

In Formula 1, the alkyl group includes a $C_1$–$C_{20}$ linear or branched radical, preferably a $C_1$–$C_{12}$ linear or branched radical, more preferably a $C_1$–$C_6$ lower alkyl. Examples of the radical include methyl, ethyl, n-propyl, isopropyl, n-butyl, isobutyl, sec-butyl, t-butyl, pentyl, iso-amyl and hexyl. $C_1$–$C_3$ lower alkyl radicals are more preferred. As used herein, the term "lower alkyl" refers to a straight or a branched chain $C_1$–$C_3$ alkyl and "lower alkyl radicals" refers to a straight or a branched chain $C_1$–$C_3$ alkyl radical.

The term "aryl", alone or in combination, means a $C_6$–$C_{20}$ carbocyclic aromatic system containing one or more rings, wherein such rings may be bonded together in a pendent manner or may be fused. Examples of the aryl group include aromatic radicals such as phenyl, naphthyl or biphenyl. Phenyl is generally preferred. The aryl group may have one to three substituents selected from hydroxy, halo, haloalkyl, nitro, alkoxy, cyano and lower alkylamino and the like.

The term "alkoxy" as used alone or in combination herein refers to an oxygen-containing, straight or branched radical having $C_1$–$C_{20}$ alkyl, preferably a $C_1$–$C_6$ lower alkoxy radical, wherein a "lower alkoxy radical" refers to a straight or a branched chain $C_1$–$C_6$ alkoxy radical. Examples of the radical include methoxy, ethoxy, propoxy, butoxy, t-butoxy and the like. The alkoxy radical is further substituted by at least one halogen atom such as fluorine, chlorine or bromine, providing a haloalkoxy radical. The $C_1$–$C_3$ lower haloalkoxy radicals are more preferred, wherein a "lower haloalkoxy radical" refers to a straight or a branched chain $C_1$–$C_3$ alkoxy radical with a hologen atom substitution. Examples of the haloalkyl radical residual potential include fluoromethoxy, chloromethoxy, trifluoromethoxy, trifluoroethoxy, fluoroethoxy and fluoropropoxy.

In the styryl group used in the compound of Formula 1, the hydrogen atom in the aromatic ring may be substituted by any substituents, for example one to three substituents such as hydroxy, halo, haloalkyl, nitro, cyano, alkoxy and lower alkylamino group. The term "lower alkylamino group" refers to a straight or a branched alky with an amino substitution.

In the alkoxycarbonyl and alkylaminocarbonyl used in the compound of Formula 2, the alkoxy and alkyl groups are as defined above.

In order to achieve the above aspects, there is provided an electrophotographic cartridge comprising a single layered electrophotographic photoreceptor that includes a photosensitive layer having at least a charge generating material, a hole transporting material, an electron transporting material, and a binder on a conductive support, wherein the photosensitive layer includes a charge transfer complex (CT-complex) formed by the hole transporting material of Formula 1 and the electron transporting material of Formula 2:

Formula 1

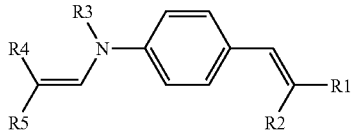

wherein R1 through R5 are independently selected from the group comprising a hydrogen atom, a $C_1$–$C_{20}$ optionally substituted alkyl group, a $C_6$–$C_{20}$ optionally substituted aryl group, a $C_1$–$C_{20}$ optionally substituted alkoxy group and a $C_8$–$C_{20}$ optionally substituted styryl group;

Formula 2

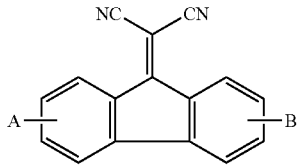

wherein A and B are independently selected from the group comprising a hydrogen atom, a halogen atom, a $C_2$–$C_{20}$ optionally substituted alkoxycarbonyl group and a $C_2$–$C_{20}$ alkylaminocarbonyl group, wherein the hydrogen atom in the aromatic ring is optionally substituted by a halogen atom; and at least one of a charging device that charges the electrophotographic photoreceptor; a developing device which develops an electrostatic latent image formed on the electrophotographic photoreceptor; and a cleaning device which cleans a surface of the electrophotographic photoreceptor, wherein the electrophotographic cartridge is attachable to/detachable from attached to an image forming apparatus.

In order to achieve the above aspects, there is provided an electrophotographic drum, comprising a drum that is attachable to and detachable from an electrophotographic apparatus; and a single layered electrophotographic photoreceptor, disposed on the drum, the single layered electrophotographic photoreceptor comprising a photosensitive layer having at least a charge generating material, a hole transporting material, an electron transporting material, and a binder on a conductive support, wherein the photosensitive layer includes a charge transfer complex (CT-complex) formed by the hole transporting material of Formula 1 and the electron transporting material of Formula 2:

Formula 1

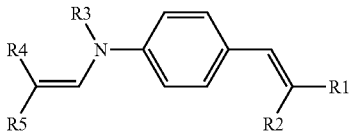

wherein R1 through R5 are independently selected from the group comprising a hydrogen atom, a $C_1$–$C_{20}$ optionally substituted alkyl group, a $C_6$–$C_{20}$ optionally substituted aryl group, a $C_1$–$C_{20}$ optionally substituted alkoxy group and a $C_8$–$C_{20}$ optionally substituted styryl group;

Formula 2

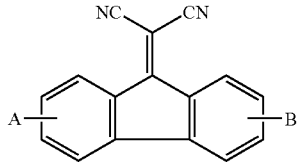

wherein A and B are independently selected from the group comprising a hydrogen atom, a halogen atom, a $C_2$–$C_{20}$ optionally substituted alkoxycarbonyl group and a $C_2$–$C_{20}$ alkylaminocarbonyl group, wherein the hydrogen atom in the aromatic ring is optionally substituted by a halogen atom.

In order to achieve the above aspects, there is provided an image forming apparatus comprising a photoreceptor unit that includes a single layered electrophotographic photoreceptor comprising a photosensitive layer having at least a charge generating material, a hole transporting material, an electron transporting material, and a binder on a conductive support, wherein the photosensitive layer includes a charge transfer complex (CT-complex) formed by the hole transporting material of Formula 1 and the electron transporting material of Formula 2:

Formula 1

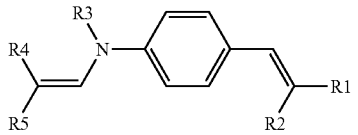

wherein R1 through R5 are independently selected from the group comprising a hydrogen atom, a $C_1$–$C_{20}$ optionally substituted alkyl group, a $C_6$–$C_{20}$ optionally substituted aryl group, a $C_1$–$C_{20}$ optionally substituted alkoxy group and a $C_8$–$C_{20}$ optionally substituted styryl group;

Formula 2

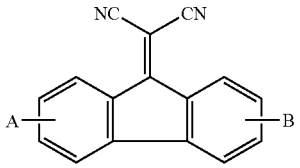

wherein A and B are independently selected from the group comprising a hydrogen atom, a halogen atom, a $C_2$–$C_{20}$ optionally substituted alkoxycarbonyl group and a $C_2$–$C_{20}$ alkylaminocarbonyl group, wherein the hydrogen atom in the aromatic ring is optionally substituted by a halogen atom; a charging device which charges the photoreceptor unit; an imagewise light irradiating device which irradiates the charged photoreceptor unit with imagewise light to form an electrostatic latent image on the photoreceptor unit; a developing unit that develops the electrostatic latent image with a toner to form a toner image on the photoreceptor unit; and a transfer device which transfers the toner image onto a receiving material.

Additional aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments taken in conjunction with the accompanying drawings, of which.

DETAILED DESCRIPTION OF THE PREFERRED EMBODIMENTS

Figure 1:
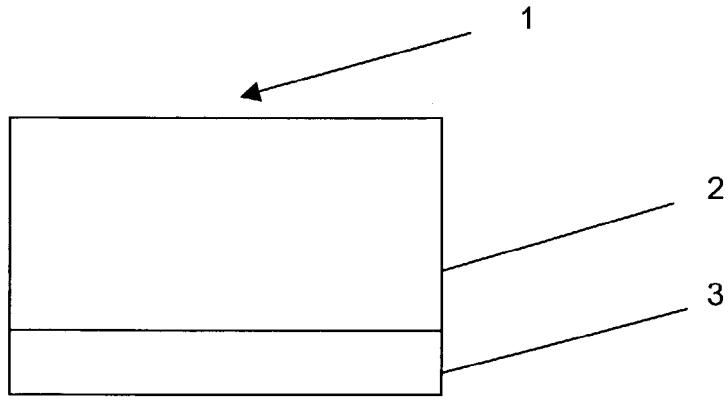
FIG. 1 is a block diagram illustrating (not to scale) an electrophotographic photoreceptor 1 comprising a photosensitive layer 2 installed on a conductive substrate 3 in accordance with an embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

The mechanism of a residual potential reducing effect of a single layered photoreceptor is considered to be as follows.

A CT-complex is generally generated by an electron transfer occurring between an electron donating material (hole transporting material) and an electron accepting material (electron transporting material) and a complex formation by ionized molecules. The CT-complex generally transports both holes and electrons, but the mobility thereof is smaller than the mobility of each single material of a hole transporting material or an electron transporting material. A diphenoquinone based compound that has been often used as an electron transporting material in the conventional single layered photoreceptor, as disclosed in Japanese Patent Laid-open Publication No. hei 1-206349, has a low electron affinity and seldom forms a CT-complex with many kinds of hole transporting materials. Accordingly, in a single layered photoreceptor, an electron transporting material contacts a charge generating material in a single molecule form, but the electron affinity is low so that the activity on hole traps, which are assumed to exist on the surface of the charge generating material, is low, and trap sites still remain, resulting in a reduction in light decay speed in a low electric field area. Another indicator is the fact that a photoreceptor, in which phthalocyanine is used as a charge generating layer and a diphenoquinone compound dispersed alone in a resin is used as a charge transporting layer, has ineffective electron injection efficiency from phthalocyanine and exhibits a high residual potential, while having effective electron mobility, as disclosed in the above-referenced Japanese Patent Publication No. hei 1-206349.

In the present invention, the electron transporting material appears to contact the charge generating material mostly in the form of a CT-complex. The electron transporting material of Formula 2 and the CT-complex formed therefrom have effective electron mobility, as is taught in Journal of Imaging Science, Vol.29, No.2, 69–72 (1985) and U.S. Pat. No. 4,559,287, disclosing the use of tetraphenylbenzidine as a hole transporting material. In the disclosure, the electron transporting capability of the CT-complex is significant. On the other hand, in the present invention, in which the hole transporting material of Formula 1 is used, there is little reduction in hole mobility due to complex formation, and an effective transporting capability of both holes and electrons is exhibited. The CT-complex used in the present invention readily takes electrons from trap sites existing on the surface of a charge generating material, and hole traps are easily filled with the electrons, without reducing the speed of a potential drop at a low electric field area.

The present invention includes an electrophotographic photoreceptor comprising a photosensitive layer having at least a charge generating material, a hole transporting material, an electron transporting material, and a binder on a conductive support, wherein the photosensitive layer includes a charge transfer complex (CT-complex) formed by the hole transporting material of Formula 1 and the electron transporting material of Formula 2:

Formula 1

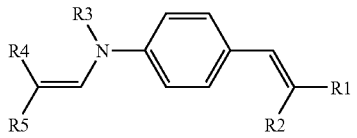

wherein R1 through R5 are independently selected from the group consisting of a hydrogen atom, a $C_1$–$C_{20}$ optionally substituted alkyl group, a $C_6$–$C_{20}$ optionally substituted aryl group, a $C_1$–$C_{20}$ optionally substituted alkoxy group and a $C_8$–$C_{20}$ optionally substituted styryl group;

Formula 2

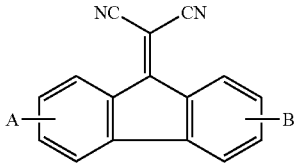

wherein A and B are independently selected from the group consisting of a hydrogen atom, a halogen atom, a $C_2$–$C_{20}$ optionally substituted alkoxycarbonyl group and a $C_2$–$C_{20}$ alkylaminocarbonyl group, wherein the hydrogen atom in the aromatic ring may be substituted by a halogen atom.

In Formula 1, the alkyl group includes a $C_1$–$C_{20}$ linear or branched radical, preferably a $C_1$–$C_{12}$ linear or branched radical, more preferably a $C_1$–$C_6$ lower alkyl. Examples of the radical include methyl, ethyl, n-propyl, isopropyl, n-butyl, isobutyl, sec-butyl, t-butyl, pentyl, iso-amyl and hexyl. $C_1$–$C_3$ lower alkyl radicals are more preferred. As used herein, the term "lower alkyl" refers to a straight or a branched chain $C_1$–$C_3$ alkyl and "lower alkyl radicals" refers to a straight or a branched chain $C_1$–$C_3$ alkyl radical.

The term "aryl", alone or in combination, means a $C_6$–$C_{20}$ carbocyclic aromatic system containing one or more rings, wherein such rings may be bonded together in a pendent manner or may be fused. Examples of the aryl group include aromatic radicals such as phenyl, naphthyl or biphenyl. Phenyl is generally preferred. The aryl group may have one to three substituents selected from hydroxy, halo, haloalkyl, nitro, alkoxy, cyano and lower alkylamino and the like.

The term "alkoxy" as used alone or in combination herein refers to an oxygen-containing, straight or branched radical having $C_1$–$C_{20}$ alkyl, preferably a $C_1$–$C_6$ lower alkoxy radical, wherein a "lower alkoxy radical" refers to a straight or a branched chain $C_1$–$C_6$ alkoxy radical. Examples of the radical include methoxy, ethoxy, propoxy, butoxy, t-butoxy and the like. The alkoxy radical is further substituted by at least one halogen atom such as fluorine, chlorine or bromine, providing a haloalkoxy radical. The $C_1$–$C_3$ lower haloalkoxy radicals are more preferred, wherein a "lower haloalkoxy radical" refers to a straight or a branched chain $C_1$–$C_3$ alkoxy radical with a hologen atom substitution. Examples of the haloalkyl radical residual potential include fluoromethoxy, chloromethoxy, trifluoromethoxy, trifluoroethoxy, fluoroethoxy and fluoropropoxy.

In the styryl group used in the compound of Formula 1, the hydrogen atom in the aromatic ring may be substituted by any substituents, for example one to three substituents such as hydroxy, halo, haloalkyl, nitro, cyano, alkoxy and lower alkylamino group. The term "lower alkylamino group" refers to a straight or a branched alky with an amino substitution.

In the alkoxycarbonyl and alkylaminocarbonyl used in the compound of Formula 2, the alkoxy and alkyl groups are as defined above.

The electrophotographic photoreceptor is a photosensitive layer coated on a conductive support. As the conductive support, a metal or plastic, drum- or belt-shaped support may, for example, be used. FIG. 1 is a block diagram illustrating (not to scale) an electrophotographic photoreceptor 1 comprising a photosensitive layer 2 installed on a conductive substrate 3 in accordance with an embodiment of the present invention.

The photosensitive layer may be a single layer including a charge generating material, a hole transporting material, a electron transporting material, and a binder.

Examples of the charge generating material used for the photosensitive layer include organic materials such as phthalocyanine pigment, azo pigment, quinone pigment, perylene pigment, indigo pigment, bisbenzoimidazole pigment, quinacridone pigment, azulenium dye, squarylium dye, pyrylium dye, triarylmethane dye, cyanine dye, and inorganic materials such as amorphous silicon, amorphous selenium, trigonal selenium, tellurium, selenium-tellurium alloy, cadmium sulfide, antimony sulfide or zinc sulfide. The charge generating materials are not limited to the materials listed herein, and may be used alone or in a combination of 2 or more mixtures thereof.

The amount of the charge generating material contained in the photosensitive layer is from 2 to 10 parts by weight based on 100 parts by weight of the solid content in the photosensitive layer. Here, the solid content of the photosensitive layer includes a charge generating material, a charge transporting material, and a binder. If the amount of the charge generating material is less than 2 parts by weight, the light absorptivity of the photosensitive layer is lowered, and an energy loss of irradiated light is increased, resulting in a decrease of sensitivity. If the amount of the charge generating material is greater than 10 parts by weight, the dark decay is considerably increased, lowering conductivity, and the trap density is also increased, lowering the sensitivity due to reduced charge mobility.

The CT-complex contained in the single layered electrophotographic photoreceptor, i.e., the CT-complex comprising a hole transporting material represented by Formula 1 and an electron transporting material represented by Formula 2, may be readily obtained by dissolving the materials in a solvent and mixing the same. In the CT-complex, since a highest occupied molecular orbital (HOMO)-lowest unoccupied molecular orbital (LUMO) transfer energy becomes smaller and there is long-wavelength absorption, generation of the CT-complex may be easily discriminated by color.

Preferred examples of the hole transporting material represented by Formula 1 forming the CT-complex include:

Formula 3

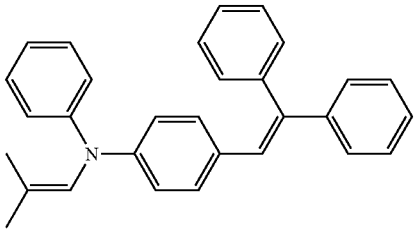

Formula 4

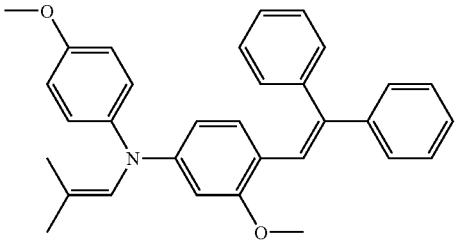

Formula 5

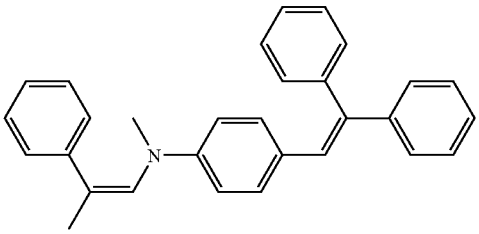

Formula 6

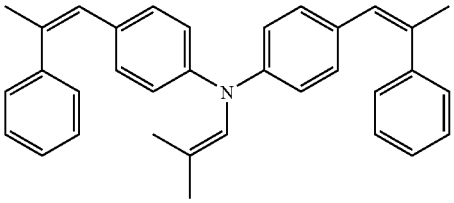

Formula 7

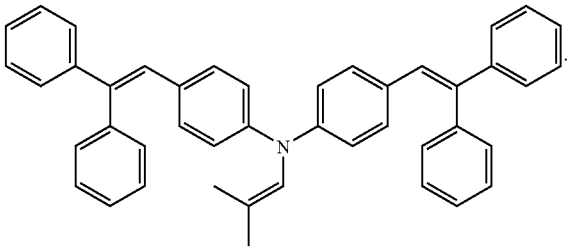

Such hole transporting materials are described in U.S. Pat. No. 5,013,623, etc., and may be easily prepared by the processes as disclosed in the same patent.

Preferred examples of the electron transporting material represented by Formula 2 forming the CT-complex include:

Formula 8

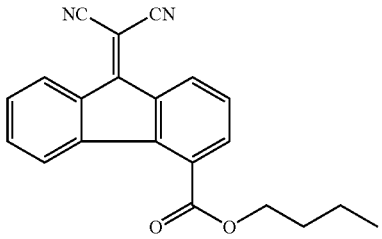

Formula 9

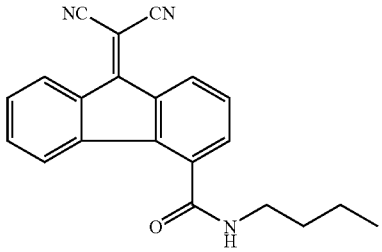

Formula 10

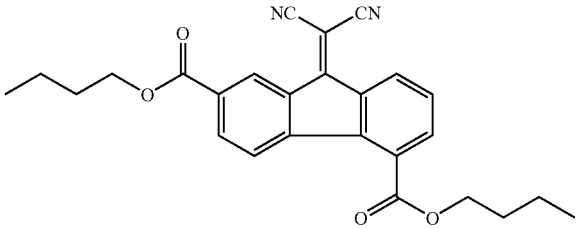

Such electron transporting materials are described in U.S. Pat. No. 4,474,865, and preparation methods thereof are also described therein. The electron transporting material represented by Formula 2 used in the present invention is readily soluble, has effective electron mobility, and is safe because it lacks a nitro group having mutagenic effects.

Quantities of the hole transporting material represented by Formula 1 and the electron transporting material represented by Formula 2 are substantially in a proportion between 9:1 to 1:1 by weight basis. If the quantities are out of the weight proportion specified above, the photosensitive layer typically fails to exert electron or hole mobility high enough for properly serving as a photoreceptor.

Also, the photosensitive layer may further include other charge transporting materials or electron transporting materials that may be used in combination within the range in which the effects and advantages of the present invention are not adversely affected.

Examples of the hole transporting material include nitrogen-containing cyclic compounds or condensed polycyclic compounds such as pyrene compounds, carbazole compounds, hydrazone compounds, oxazole compounds, oxadiazole compounds, pyrazoline compounds, arylamine compound, arylmethane compounds, benzidine compounds, thiazole compounds or styryl compounds.

Examples of the electron transporting material include, but are not limited to, electron attracting low-molecular weight compounds such as benzoquinone compounds, cyanoethylene compounds, cyanoquinodimethane compounds, fluorenone compounds, xanthaones compounds, phenanthraquinone compounds, anhydrous phthalic acid compounds, thiopyrane compounds or diphenoquinone compounds. Electron transporting polymer compounds or electron transporting pigments may also be used.

The charge transporting material that may be used with the electrophotographic photoreceptor according to the present invention is not limited to the materials listed herein, and such materials may be used alone or in combination.

It is preferable that the amount of the charge transporting material be in the range of about 10–60 parts by weight based on 100 parts by weight of the solid content in the weight of the photosensitive layer. If the amount of the charge transporting material is less than 10 parts by weight, an insufficient charge transporting capability results, so that the sensitivity is low, and the residual potential increases. If the amount of the charge transporting material is greater than 60 parts by weight, the relative amount of the resin contained in the photosensitive layer is reduced, and an effective coating property cannot be sufficiently obtained.

Preferred examples of the binder for use in the charge generating material include, but are not limited to, electrically insulating condensed polymers, for example, polycarbonate, polyester, methacryl resin, acryl resin, polyvinyl chloride, polyvinylidene chloride, polystyrene, polyvinyl acetate, silicon resin, silicon-alkyd resin, styrene-alkyd resin, poly-N-vinylcarbazole, phenoxy resin, epoxy resin, polyvinyl butyral, polyvinyl acetal, polyvinyl formal, polysulfone, polyvinyl alcohol, ethyl cellulose, phenol resin, polyamide, carboxy-metal cellulose and polyurethane. The condensed polymers may be used alone or in combination of two or more kinds of the materials.

The thickness of the photosensitive layer is generally in the range of 5 to 50 μm.

Examples of solvents used in the coating technique include organic solvents such as alcohols, ketones, amides, ethers, esters, sulfones, aromatics, aliphatic halogenated hydrocarbons and the like. Examples of the coating technique include a dip coating method, a ring coating method, a roll coating method or a spray coating method, but any coating technique may be applied to the electrophotographic photoreceptor according to the present invention.

Alternatively, an intermediate layer may be installed between the conductive support and the photosensitive layer for the purpose of enhancing adhesion or preventing charges from being injected from the support. Examples of the intermediate layer include, but not limited to, an aluminum anodized layer, a resin-dispersed layer of metal oxide powder such as titanium oxide or tin oxide, and a resin layer such as polyvinyl alcohol, casein, ethylcellulose, gelatin, phenol resin or polyamide.

Also, the photosensitive layer may contain a plasticizer, a leveling agent, a dispersion-stabilizing agent, an antioxidant or a photo-stabilizing agent, in addition to the binder.

Examples of the antioxidant include phenol compounds, sulfur compounds, phosphorus compounds or amine compounds.

Examples of the photo-stabilizing agent include benzotriazole compounds, benzophenone compound, or hindered amine compounds.

The present invention is explained in detail hereinbelow with reference to examples. However, it should be understood that the invention is not limited to the examples.

In the examples and comparative examples, all "parts" means "parts by weight".

EXAMPLE 1

3 parts of γ-titanyl phthalocyanine and 2 parts of polycarbonate Z resin (PANLITE TS-2020, manufactured by TAIJIN CHEMICALS) were mixed with 45 parts of chloroform, and pulverized using a sand mill for 1 hour and dispersed.

Next, 35 parts of a hole transporting material represented by Formula 3, 15 parts of an electron transporting material represented by Formula 8, 50 parts of polycarbonate Z resin were dissolved in 300 parts of chloroform, yielding a dark green solution, by which formation of a CT-complex was confirmed.

The dispersed solution and the dark green solution were mixed in a ratio of 1:8 and dispersed using a homogenizer until the mixture was homogenized, yielding a photosensitive layer coating solution. Next, the resulting coating solution was coated on an aluminum drum having a diameter of 30 mm by a ring coating method, and dried to obtain a 20 thick, single layered electrophotographic photoreceptor.

EXAMPLES 2–3 AND COMPARATIVE EXAMPLES 1–3

Electrophotographic photoreceptors were obtained in the same manner as in Example 1, except that the combination of the hole transporting material of Formula 3 and the electron transporting material of Formula 8 was changed as shown in Table 1.

TABLE 1

| Sample | Hole transporting material | Electron transporting material | Generation of CT-complex |
|---|---|---|---|
| Example 2 | Compound of Formula 5 | Compound of Formula 9 | Yes |
| Example 3 | Compound of Formula 6 | Compound of Formula 10 | Yes |
| Comparative Example 1 | Compound of Formula 11 | Compound of Formula 8 | Yes |
| Comparative Example 2 | Compound of Formula 3 | Compound of Formula 12 | No |
| Comparative Example 3 | Compound of Formula 11 | Compound of Formula 12 | No |

Formula 11

TABLE 1-continued

| Sample | Hole transporting material | Electron transporting material | Generation of CT-complex |
|---|---|---|---|

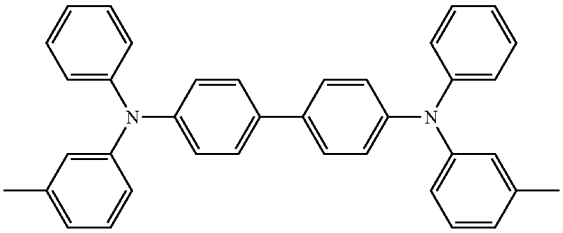

Formula 12

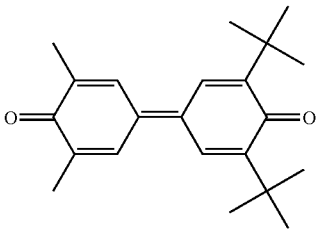

Electrostatic Properties

Electrophotographic characteristics of the respective photoreceptors were evaluated using a photoreceptor evaluation apparatus (PDT-2000 manufactured by QEA). Measurement conditions were as follows. Each electrophotographic photoreceptor was charged by applying a corona voltage of ±7.5 kV, at a relative speed of a charger to the photoreceptor of 100 mm/sec, and then exposed to a monochromatic light of 780 nm with an exposure energy in the range of 0 to 10 mJ/m$^2$, to measure the surface potential (VL.sub.0.2) remaining on the surface of the receptor after exposure. The energy-to-surface potential relationship was measured. Here, when a surface potential without light irradiation is denoted by $V_0$ and a surface potential after standing for 1 second in the dark is denoted by $V_1$, $V_1/V_0$ represents a potential maintenance ratio. Energy required for a half decay of $V_0$ with light irradiation is denoted by $E_{1/2}$. A potential after standing 10 seconds after irradiating light of 100 mJ/m$^2$ is a residual potential denoted by $V_R$.

The measurement results are shown in Table 2.

TABLE 2

| Sample | $V_0$ | $V_1/V_0$ | $E_{1/2}$ | $V_R$ |
|---|---|---|---|---|
| Example 1 | 605 | 95 | 1.21 | 18 |
| Example 2 | 609 | 96 | 1.25 | 20 |
| Example 3 | 612 | 97 | 1.23 | 23 |
| Comparative Example 1 | 564 | 84 | 1.80 | 46 |
| Comparative Example 2 | 615 | 97 | 1.20 | 38 |
| Comparative Example 3 | 587 | 86 | 1.58 | 53 |

In Table 2, compared to the photoreceptor prepared in Comparative Example 3, the photoreceptors prepared in the Examples 1–3 had effective charge properties and sensitivity and low residual potentials of approximately 20 V. While the photoreceptor prepared in Comparative Example 1, in which a hole transporting material was replaced by a tetraphenylbenzidine compound of Formula 11, was combined with the electron transporting material of Formula 8 used in Example 1 of the present invention, forming a CT-complex, the photoreceptor of Comparative Example 1 had ineffective charge properties. Also, the photoreceptor prepared in Comparative Example 1 exhibited poor sensitivity and residual potential characteristics and considerably reduced sensitivity compared to the photoreceptor prepared in Comparative Example 3. This may be because the transporting capability of the hole transporting material is reduced due to generation of the CT-complex, resulting in a reduction in concentration of the hole transporting material. In the photoreceptors prepared in Comparative Examples 2 and 3 in which a diphenoquinone compound of Formula 12 was used as an electron transporting material, a CT-complex was not generated. In the photoreceptor prepared in Comparative Example 2 in which the photoreceptor was combined with the hole transporting material of Formula 3 used in Example 1 of the present invention, the photoreceptor had effective charge properties and sensitivity. However, the photoreceptor prepared in Comparative Example 2 still had problems such as a high residual potential, because of reduced discharge at a low electric potential area.

As described above, the single layered electrophotographic photoreceptor according to the present invention overcomes the conventional problem, that is, a decrease in the speed of a potential drop at a low electric field area, and has effective charge properties, sensitivity and residual potential characteristics, thus realizing a more practically advantageous single layered photoreceptor.

Figure 2:
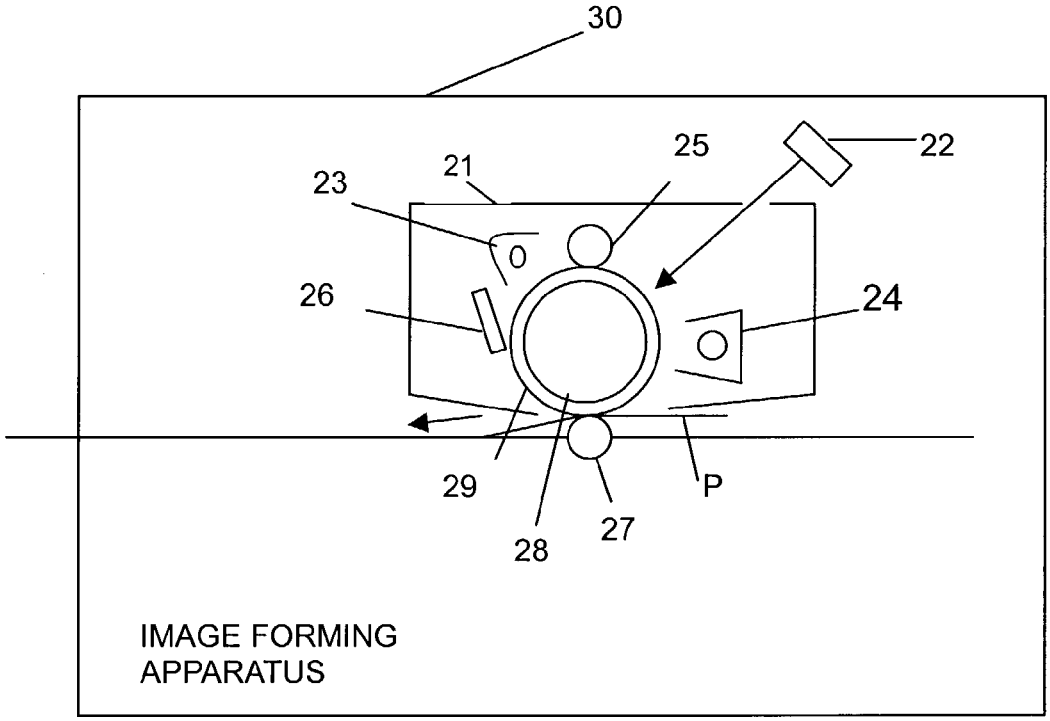
FIG. 2 is a schematic representation of an image forming apparatus, an electrophotgraphic drum, and an electrophographic cartridge in accordance with selected embodiments of the present invention.

FIG. 2 is a schematic representation of an image forming apparatus 30, an electrophotgraphic drum 28, and an electrophographic cartridge 29 in accordance with selected embodiments of the present invention. The electrophotographic cartridge 29 typically comprises an electrophotographic photoreceptor 29 and at least one of a charging device 25 that charges the electrophotographic photoreceptor 29, a developing device 24 which develops an electrostatic latent image formed on the electrophotographic photoreceptor 29, and a cleaning device 26 which cleans a surface of the electrophotographic photoreceptor 29. The electrophotographic cartridge 21 may be attached to or detached from the image forming apparatus 30, and the electrophotographic photoreceptor 29 is described more fully above.

The electrophotographic photoreceptor drum 28, 29 for an image forming apparatus 30, generally includes a drum 28 that is attachable to and detachable from the electrophotographic apparatus 30 and that includes an electrophotographic photoreceptor 29 disposed on the drum 28, wherein the electrophotographic photoreceptor 29 is described more fully above.

Generally, the image forming apparatus 30 includes a photoreceptor unit (e.g., an electrophotographic photoreceptor drum 28, 29), a charging device 25 which charges the photoreceptor unit, an imagewise light irradiating device 22 which irradiates the charged photoreceptor unit with imagewise light to form an electrostatic latent image on the photoreceptor unit, a developing unit 24 that develops the electrostatic latent image with a toner to form a toner image on the photoreceptor unit, and a transfer device 27 which transfers the toner image onto a receiving material, such as paper P, wherein the photoreceptor unit comprises an electrophotographic photoreceptor 29 as described in greater detail above. The charging device 25 may be supplied with a voltage as a charging unit and may contact and charge the electrophotographic receptor. Where desired, the apparatus may include a pre-exposure unit 23 to erase residual charge on the surface of the electrophotographic photoreceptor to prepare for a next cycle.

Although a few embodiments of the present invention have been shown and described, it will be appreciated by those skilled in the art that changes may be made in this embodiment without departing from the principles and spirit of the invention, the scope of which is defined in the claims and their equivalents.

What is claimed is:

1. A single layered electrophotographic photoreceptor comprising:

a photosensitive layer having at least a charge generating material, a hole transporting material, an electron transporting material, and a binder on a conductive support, wherein the photosensitive layer includes a charge transfer complex (CT-complex) formed by the hole transporting material of Formula 1 and the electron transporting material of Formula 2:

Formula 1

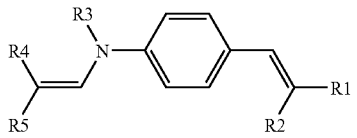

wherein R1 through R5 are independently selected from the group comprising a hydrogen atom, a $C_1$–$C_{20}$ optionally substituted alkyl group, a $C_6$–$C_{20}$ optionally substituted aryl group, a $C_1$–$C_{20}$ optionally substituted alkoxy group and a $C_8$–$C_{20}$ optionally substituted styryl group;

Formula 2

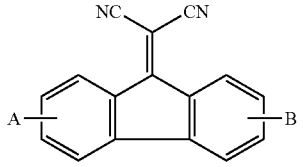

wherein A and B are independently selected from the group comprising a hydrogen atom, a halogen atom, a $C_2$–$C_{20}$ optionally substituted alkoxycarbonyl group and a $C_2$–$C_{20}$ alkylaminocarbonyl group, wherein the hydrogen atom in the aromatic ring is optionally substituted by a halogen atom.

2. The photoreceptor of claim 1, wherein quantities of the hole transporting material represented by Formula 1 and the electron transporting material represented by Formula 2 are in a proportion between substantially 9:1 to 1:1 by weight basis.

3. The photoreceptor of claim 1, wherein the charge generating material in the photosensitive layer is at least one selected from the group consisting of phthalocyanine pigment, azo pigment, quinone pigment, perylene pigment, indigo pigment, bisbenzoimidazole pigment, quinacridone pigment, azulenium dye, squarylium dye, pyrylium dye, triarylmethane dye, cyanine dye, and inorganic materials such as amorphous silicon, amorphous selenium, trigonal selenium, tellurium, selenium-tellurium alloy, cadmium sulfide, antimony sulfide and zinc sulfide.

4. The photoreceptor of claim 1, wherein the amount of the charge generating material is in a range of 2–10 parts by weight based on 100 parts by weight of the solid content in the weight of the photosensitive layer.

5. The photoreceptor of claim 1, wherein the hole transporting material of Formula 1 is a compound represented by one of Formula 3, 4, 5, 6 and 7:

Formula 3

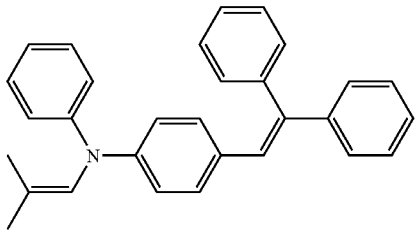

Formula 4

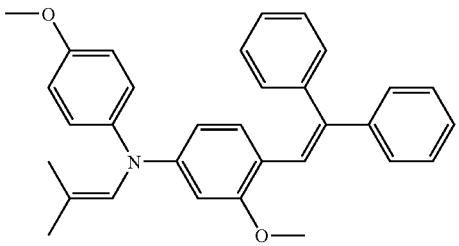

-continued

Formula 5

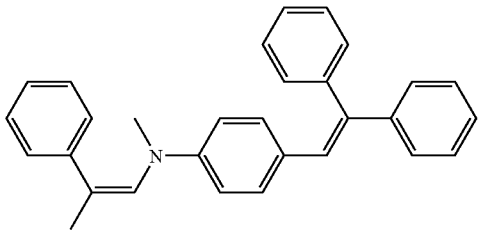

Formula 6

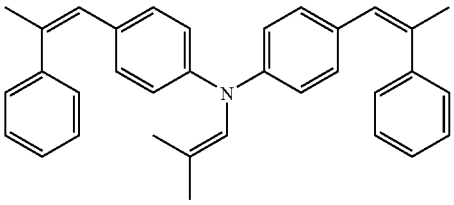

Formula 7

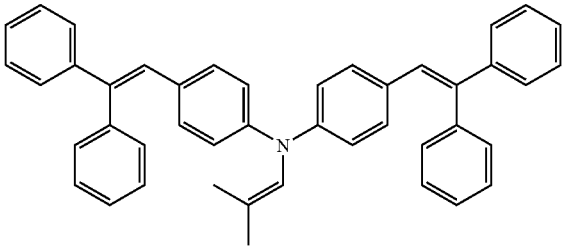

6. The photoreceptor of claim 1, wherein the electron transporting material of Formula 2 is a compound represented by one of Formula 8, 9 and 10:

Formula 8

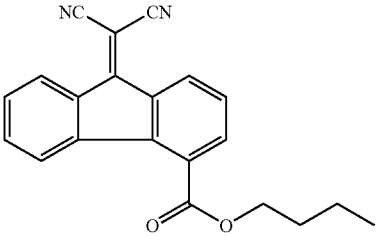

Formula 9

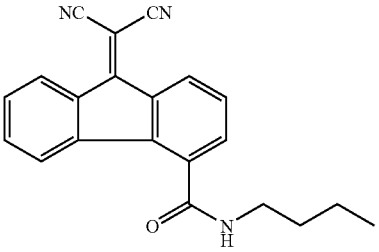

-continued

Formula 10

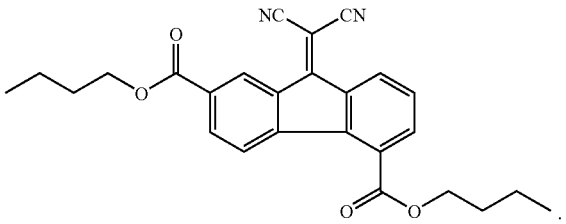

7. The photoreceptor of claim 1, wherein the hole transporting material is used in combination with at least one selected from the group consisting of pyrene compounds, carbazole compounds, hydrazone compounds, oxazole compounds, oxadiazole compounds, pyrazoline compounds, arylamine compound, arylmethane compounds, benzidine compounds, thiazole compounds and styryl compounds.

8. The photoreceptor of claim 1, wherein the electron transporting material is used in combination with at least one selected from the group consisting of electron attracting low-molecular weight compounds including benzoquinone compounds, cyanoethylene compounds, cyanoquinodimethane compounds, fluorenone compounds, xanthaones compounds, phenanthraquinone compounds, anhydrous phthalic acid compounds, thiopyrane compounds and diphenoquinone compounds, electron transporting polymer compounds and electron transporting pigments.

9. The photoreceptor of claim 1, wherein the amount of the charge transporting material is substantially from 10 to 60 parts by weight based on 100 parts by weight of the solid content in the weight of the photosensitive layer.

10. The photoreceptor of claim 1, wherein the binder is at least one selected from the group consisting of polycarbonate, polyester, methacryl resin, acryl resin, polyvinyl chloride, polyvinylidene chloride, polystyrene, polyvinyl acetate, silicon resin, silicon-alkyd resin, styrene-alkyd resin, poly-N-vinylcarbazole, phenoxy resin, epoxy resin, polyvinyl butyral, polyvinyl acetal, polyvinyl formal, polysulfone, polyvinyl alcohol, ethyl cellulose, phenol resin, polyamide, carboxy-metal cellulose and polyurethane.

11. The photoreceptor of claim 1, wherein the thickness of the photosensitive layer is in a range of 5 to 50 μm.

12. The photoreceptor of claim 1, further comprising an intermediate layer between the conductive support and the photosensitive layer, wherein the intermediate layer is at least a layer selected from the group consisting of an aluminum anodized layer, a resin-dispersed layer of metal oxide powder comprising one of titanium oxide and tin oxide, and a resin layer comprising polyvinyl alcohol, casein, ethylcellulose, gelatin, phenol resin and polyamide.

13. The photoreceptor of claim 1, wherein the photosensitive layer includes at least one selected from the group consisting of a plasticizer, a leveling agent, a dispersion-stabilizing agent, an antioxidant and a photo-stabilizing agent.

14. An electrophotographic cartridge, comprising:

a single layered electrophotographic photoreceptor comprising:

a photosensitive layer having at least a charge generating material, a hole transporting material, an electron transporting material, and a binder on a conductive support, wherein the photosensitive layer includes a charge transfer complex (CT-complex) formed by the hole transporting material of Formula 1 and the electron transporting material of Formula 2:

Formula 1

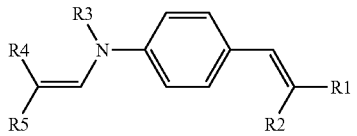

wherein R1 through R5 are independently selected from the group comprising a hydrogen atom, a $C_1$–$C_{20}$ optionally substituted alkyl group, a $C_6$–$C_{20}$ optionally substituted aryl group, a $C_1$–$C_{20}$ optionally substituted alkoxy group and a $C_8$–$C_{20}$ optionally substituted styryl group;

Formula 2

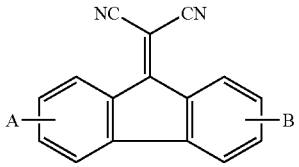

wherein A and B are independently selected from the group comprising a hydrogen atom, a halogen atom, a $C_2$–$C_{20}$ optionally substituted alkoxycarbonyl group and a $C_2$–$C_{20}$alkylaminocarbonyl group, wherein the hydrogen atom in the aromatic ring is optionally substituted by a halogen atom; and at least one of:

a charging device that charges the electrophotographic photoreceptor;

a developing device which develops an electrostatic latent image formed on the electrophotographic photoreceptor; and a cleaning device which cleans a surface of the electrophotographic photoreceptor, wherein the electrophotographic cartridge is attachable to/detachable from attached to an image forming apparatus.

15. The electrophotographic cartridge of claim 14, wherein quantities of the hole transporting material represented by Formula 1 and the electron transporting material represented by Formula 2 are in a proportion between substantially 9:1 to 1:1 by weight basis.

16. The electrophotographic cartridge of claim 14, wherein the hole transporting material of Formula 1 is a compound represented by one of Formula 3, 4, 5, 6 and 7:

Formula 3

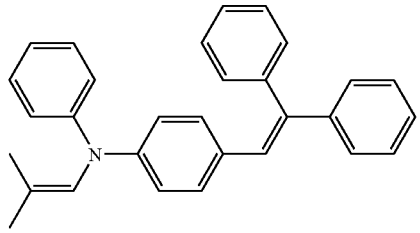

Formula 4

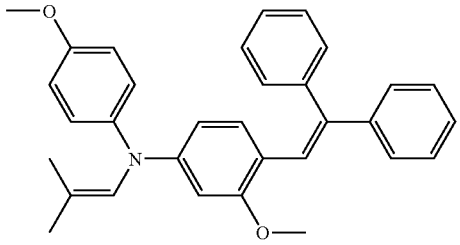

Formula 5

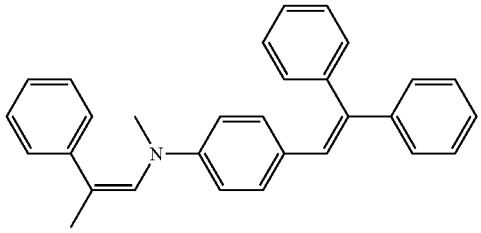

Formula 6

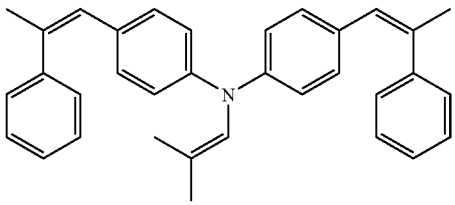

Formula 7

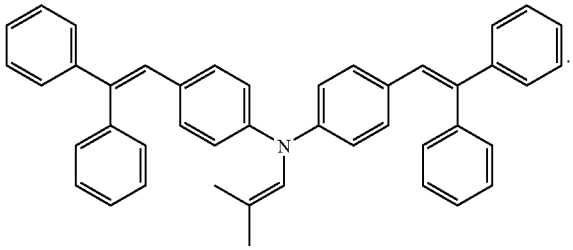

17. The electrophotographic cartridge of claim 14, wherein the electron transporting material of Formula 2 is a compound represented by one of Formula 8, 9 and 10:

Formula 8

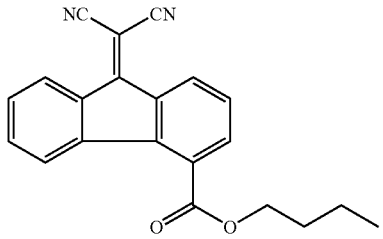

Formula 9

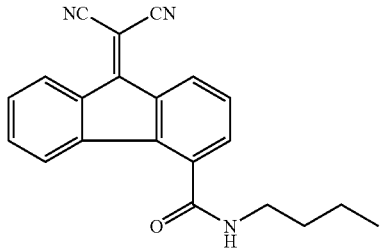

Formula 10

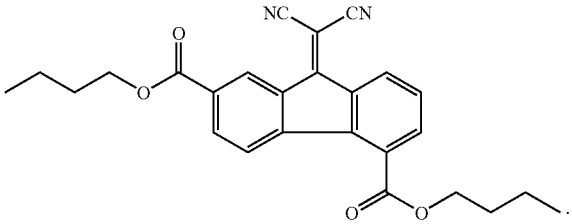

18. An electrophotographic drum, comprising:

a drum that is attachable to and detachable from an electrophotographic apparatus; and a single layered electrophotographic photoreceptor, disposed on the drum, the single layered electrophotographic photoreceptor comprising:

a photosensitive layer having at least a charge generating material, a hole transporting material, an electron transporting material, and a binder on a conductive support, wherein the photosensitive layer includes a charge transfer complex (CT-complex) formed by the hole transporting material of Formula 1 and the electron transporting material of Formula 2:

Formula 1

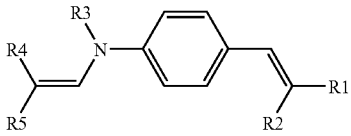

wherein R1 through R5 are independently selected from the group comprising a hydrogen atom, a $C_1$–$C_{20}$ optionally substituted alkyl group, a $C_6$–$C_{20}$ optionally substituted aryl group, a $C_1$–$C_{20}$ optionally substituted alkoxy group and a $C_8$–$C_{20}$ optionally substituted styryl group;

Formula 2

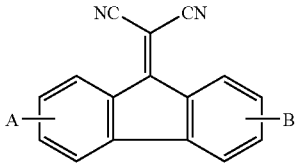

wherein A and B are independently selected from the group comprising a hydrogen atom, a halogen atom, a $C_2$–$C_{20}$ optionally substituted alkoxycarbonyl group and a $C_2$–$C_{20}$ alkylaminocarbonyl group, wherein the hydrogen atom in the aromatic ring is optionally substituted by a halogen atom.

19. The electrophotographic drum of claim 18, wherein quantities of the hole transporting material represented by Formula 1 and the electron transporting material represented by Formula 2 are in a proportion between substantially 9:1 to 1:1 by weight basis.

20. The electrophotographic drum of claim 18, wherein the hole transporting material of Formula 1 is a compound represented by one of Formula 3, 4, 5, 6 and 7:

Formula 3

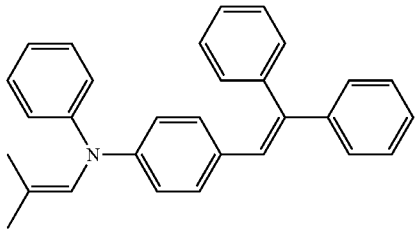

Formula 4

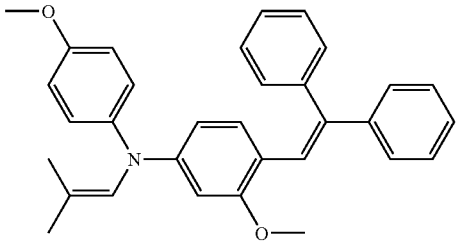

Formula 5

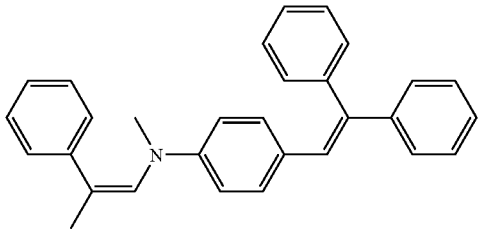

Formula 6

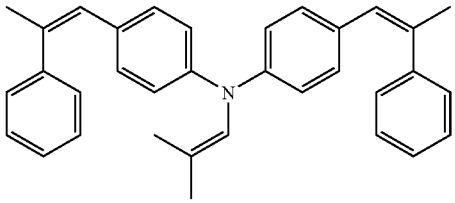

-continued

Formula 7

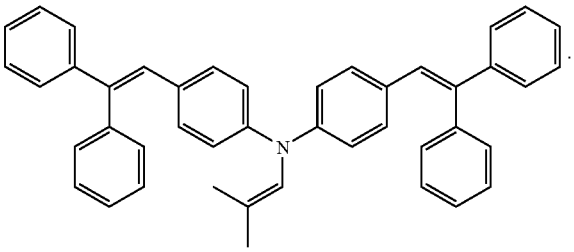

21. The electrophotographic drum of claim 18, wherein the electron transporting material of Formula 2 is a compound represented by one of Formula 8, 9 and 10:

Formula 8

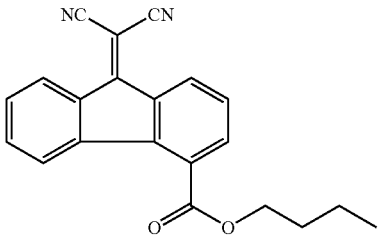

Formula 9

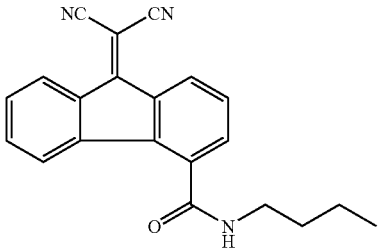

Formula 10

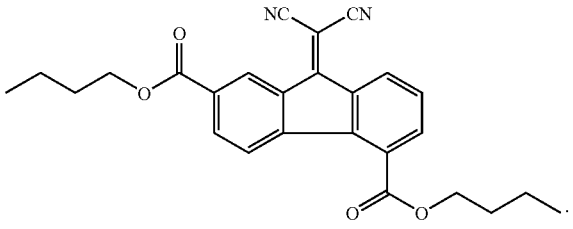

22. An image forming apparatus comprising:

a photoreceptor unit comprising:

a single layered electrophotographic photoreceptor comprising:

a photosensitive layer having at least a charge generating material, a hole transporting material, an electron transporting material, and a binder on a conductive support, wherein the photosensitive layer includes a charge transfer complex (CT-complex) formed by the hole transporting material of Formula 1 and the electron transporting material of Formula 2:

Formula 1

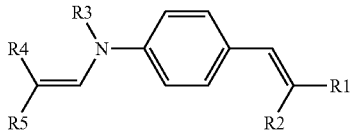

wherein R1 through R5 are independently selected from the group comprising a hydrogen atom, a $C_1$–$C_{20}$ optionally substituted alkyl group, a $C_6$–$C_{20}$ optionally substituted aryl group, a $C_1$–$C_{20}$ optionally substituted alkoxy group and a $C_8$–$C_{20}$ optionally substituted styryl group;

Formula 2

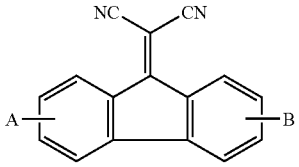

wherein A and B are independently selected from the group comprising a hydrogen atom, a halogen atom, a $C_2$–$C_{20}$ optionally substituted alkoxycarbonyl group and a $C_2$–$C_{20}$ alkylaminocarbonyl group, wherein the hydrogen atom in the aromatic ring is optionally substituted by a halogen atom;

a charging device which charges the photoreceptor unit;

an imagewise light irradiating device which irradiates the charged photoreceptor unit with imagewise light to form an electrostatic latent image on the photoreceptor unit;

a developing unit that develops the electrostatic latent image with a toner to form a toner image on the photoreceptor unit; and a transfer device which transfers the toner image onto a receiving material.

23. The image forming apparatus of claim 22, wherein quantities of the hole transporting material represented by Formula 1 and the electron transporting material represented by Formula 2 are in a proportion between substantially 9:1 to 1:1 by weight basis.

24. The image forming apparatus of claim 22, wherein the hole transporting material of Formula 1 is a compound represented by one of Formula 3, 4, 5, 6 and 7:

Formula 3

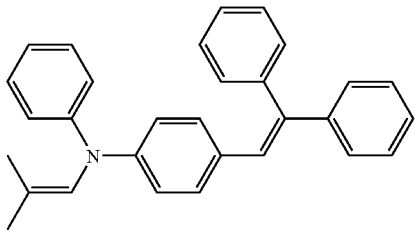

-continued
Formula 4
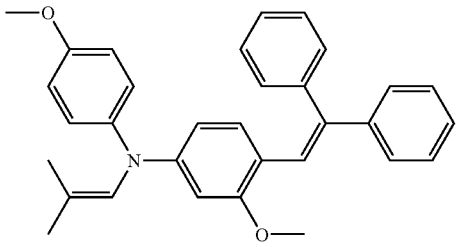
Formula 5
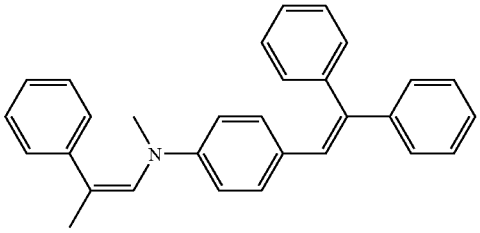
Formula 6
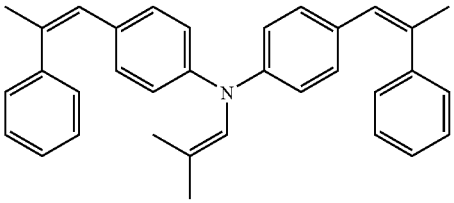
Formula 7
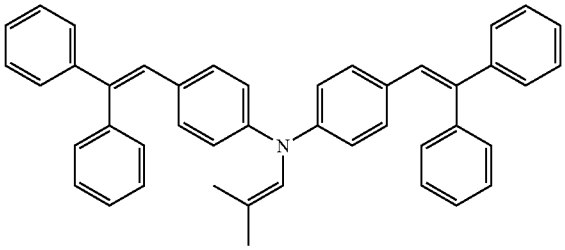
25. The image forming apparatus of claim 22, wherein the electron transporting material of Formula 2 is a compound represented by one of Formula 8, 9 and 10:
Formula 8
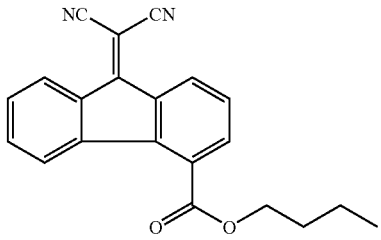
Formula 9
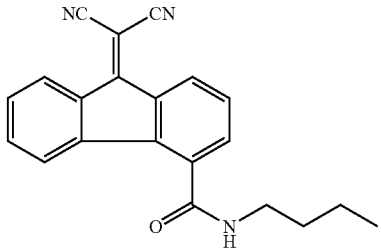
Formula 10
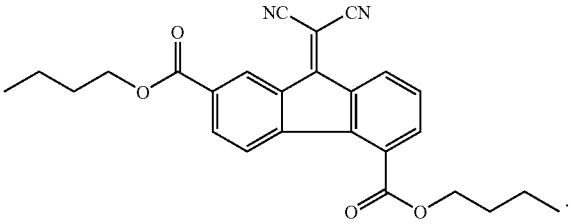
* * * * *